US007325656B2

(12) United States Patent
Oberer et al.

(10) Patent No.: US 7,325,656 B2
(45) Date of Patent: Feb. 5, 2008

(54) ELEVATOR INSTALLATION WITH DEVICE FOR NOISE REDUCTION

(75) Inventors: Alex Oberer, Ennetbürgen (CH); Yvan Kurzo, Luzern (CH); Philipp Leister, Stuttgart (DE)

(73) Assignee: Inventio AG, Hergiswil NW (CH)

( * ) Notice: Subject to any disclaimer, the term of this patent is extended or adjusted under 35 U.S.C. 154(b) by 0 days.

(21) Appl. No.: 11/420,306

(22) Filed: May 25, 2006

(65) Prior Publication Data

US 2006/0289242 A1 Dec. 28, 2006

(30) Foreign Application Priority Data

May 25, 2005 (EP) ..... 05104492

(51) Int. Cl.
*B66B 13/24* (2006.01)
*A47B 81/06* (2006.01)

(52) U.S. Cl. ..... 187/336; 187/401; 181/198; 181/284

(58) Field of Classification Search ..... 187/336, 187/401; 151/284, 198; 181/286
See application file for complete search history.

(56) References Cited

U.S. PATENT DOCUMENTS 3,239,031 A * 3/1966 Lodige ..... 187/336
3,831,710 A * 8/1974 Wirt ..... 181/286
4,759,000 A * 7/1988 Reitz ..... 367/176
4,948,660 A * 8/1990 Rias et al. ..... 442/378
5,108,833 A * 4/1992 Noguchi et al. ..... 428/310.5
5,164,260 A * 11/1992 Yoshinaka et al. ..... 428/328
5,220,979 A * 6/1993 Matsuda ..... 187/401
6,102,163 A * 8/2000 Liebetrau et al. ..... 187/250
6,109,388 A * 8/2000 Tsukamoto et al. ..... 181/286

FOREIGN PATENT DOCUMENTS

JP 11011838 1/1999
JP 2001106460 4/2001
JP 2001316060 11/2001
JP 2002193569 7/2002

* cited by examiner

*Primary Examiner*—Patrick Mackey
*Assistant Examiner*—Terrell Matthews
(74) *Attorney, Agent, or Firm*—Fraser Clemens Martin & Miller LLC; William J. Clemens

(57) ABSTRACT

An elevator installation includes an elevator car that moves in an elevator shaft with shaft doors and which car has at least one car apron arranged parallel to a plane of a shaft wall at a shaft door side. A device for reducing noises generated by the air flow arising between the shaft wall and the car apron includes sound-absorbing material that is mounted at the car apron and at the shaft wall.

24 Claims, 2 Drawing Sheets

ELEVATOR INSTALLATION WITH DEVICE FOR NOISE REDUCTION

BACKGROUND OF THE INVENTION

The subject of the present invention is an elevator installation with an elevator car which moves in an elevator shaft with shaft doors, wherein the elevator car has at least one car apron and a device for reducing noises, which noises arise as a consequence of an air flow occurring between a shaft wall and the car apron, and the device is present in the region of the car apron.

Car aprons are plate-shaped elements which in the region of the front, which is at the door side, of an elevator car typically extend approximately a meter of length from the underside of the elevator car downwardly or from the upper side of the elevator car upwardly. They serve on the one hand for protection of the toes of passengers against being caught between car door threshold and shaft door threshold if the elevator car has not stopped exactly at floor height. On the other hand, they prevent passengers from falling down in the elevator shaft when they have to be evacuated from a jammed elevator car while the car threshold is located substantially above the building floor. In the case of high-speed elevator cars the car aprons also have the task of producing a course, which is as laminar as possible, of the air flow between the front of the elevator car and the wall of the elevator shaft at the shaft door side.

Such a device is shown in Japanese patent document JP 2001316060. The wind noises arising in the region of a lower or an upper car apron of an elevator car as a consequence of the air flow are attenuated by a sound transmitter. This is installed in the region of a car apron on the side thereof remote from the opposite shaft wall and generates sound waves which counteract, by sound waves of opposite phase, the sound waves of the wind noises detected by a sensor.

The device disclosed in JP 2001316060 has high costs for provision of the requisite components. Moreover, installation thereof is complicated and requires special knowledge by the installation and maintenance personnel. Moreover, such a complex electronic/acoustic system always is a source of failure.

SUMMARY OF THE INVENTION

The present invention has an object of proposing an elevator installation of the kind stated in the above introduction, which does not have the mentioned disadvantages of the device cited as state of the art. In particular, there shall thus be created a device for an elevator car with a car apron by which the wind noises generated by the air flow between the car apron and the opposite shaft wall containing the shaft doors can be reduced in economic and operationally reliable manner by simple means.

According to the present invention the object is fulfilled in that in the case of an elevator installation with an elevator car comprising at least one car opening in which a device is present which comprises sound-absorbing means, which are mounted in the region of the car apron, for reducing noises arising in the region of the car apron.

The present invention is accordingly based on the concept of damping the creation and transmission of wind and noises, which wind and noises are generated during travel of the elevator car by the air flow occurring between the front of the elevator car with the car apron and the oppositely disposed shaft wall, with the help of sound-absorbing means mounted in the region of the car apron. There shall thus be avoidance of wind noises reaching, without hindrance, the passenger space of the elevator car or propagating in the elevator shaft.

The advantages achieved by the present invention are that the damping of wind noises produced in the region of the car apron is achieved by economic means and that little complication and no specially skilled personnel are required for installation and maintenance of these means. Moreover, the proposed device does not have the consequence of any increase in risk of operational failures, since no sensors, sound transmitters and/or electronic circuits and wiring are required.

A refinement of the elevator installation according to the present invention with enhanced effectiveness with respect to noise reduction consists in that sound-absorbing means are also mounted in the region of shaft door aprons. The sound-absorbing means in that case advantageously extend over the entire region between two shaft doors. In the case of large distances between two adjacent shaft doors the shaft door aprons can also have in each instance only a limited height, for example the prescribed height of a shaft door apron.

For reduction of noises in lower frequency ranges a form of embodiment of the present invention is suitable in which the sound-absorbing means comprise at least one resonance absorber. Resonance absorbers can be constructed as, for example, micro-perforated absorbers, such as spring/mass resonance absorbers or as composite plate resonators, preferably in the form of plate-shaped constructions.

A particularly preferred embodiment of the present invention consists in that the sound-absorbing means comprises a porous sound absorption layer mounted in the region of the car apron. Preferably materials such as mineral fibers, organic fibers, open-cell foam materials, etc., are suitable for use in a porous sound absorption layer according to the present invention. Noises with wide frequency spectrum can be damped by absorption by such a porous sound absorption layer.

According to an advantageous embodiment of the present invention the sound absorption layer is arranged parallel to the main plane of the car apron. Denoted as main plane is the plane of the car apron which faces the shaft wall at the door side and which lies parallel to the shaft wall at the door side or to the front of the elevator car at the door side and is aligned with the front edge of the car door threshold.

According to a further preferred embodiment of the present invention the sound absorption layer is present in the form of a prefabricated plate of sound-absorbing material. This can be retained in, for example, a metal box forming the main plane of the car apron or also be fixed only to a stabilizing metal plate (for example, to a metal plate forming the main plane of the car apron) or be a self-supporting component forming the car apron.

Good noise damping values in the case of noises with wide frequency spectrum can be achieved by a porous sound absorption layer of mineral fibers (for example, glass fibers, rock wool fibers, ceramic fibers), organic fibers, open-cell foam materials (for example, PUR foam material, melamine resin foam material), etc. Sound absorption layers of mixtures of different materials can also be used.

An expedient development of the present invention with respect to expansion of the sound absorption spectrum consists in that the porous sound absorption layer comprises in the region of the car apron or the shaft door apron several part layers of different sound-absorbing materials in order to provide optimum attenuation of wind noises with significantly different sound frequencies.

Advantageously vibratory plates, which are preferably metallic and which act as vibrational intermediate masses and optimize the sound-absorbing action, are inserted between the part layers of the sound absorption layer.

Economically meaningful damping results can be achieved with a porous sound absorption layer having a thickness of 20 millimeters to 200 millimeters, preferably 50 millimeters to 150 millimeters, measured at right angles to the shaft wall at the shaft door side.

An advantageous form of embodiment of the present invention consists in that the car apron comprises a metal plate which is arranged parallel to the main plane of the apron and against which the porous sound absorption layer bears. The metal plate in that case forms a stabilizing element of the car apron in that it supports and retains the sound absorption layer.

Advantageously the porous sound absorption layer is arranged on the side of the metal plate remote from the shaft wall at the shaft door side. In the case of this arrangement the metal plate protects the sound absorption layer from mechanical damage by passengers when, for example, the safety functions, which were described in the introduction, of the car apron are called into play.

According to a particularly preferred embodiment of the present invention, in which the porous sound absorption layer is arranged on the side of the metal plate remote from the shaft wall at the shaft wall side, the metal plate has a plurality of holes. Tests have shown that with such a form of embodiment of the car apron the sound-absorbing effect can be decisively improved by comparison with a construction with a sound absorption layer completely covered by a metal plate.

Good sound absorption results are achieved if the holes in the apron plate are circular and have a diameter of 2 millimeters to 20 millimeters and their entire hole area makes up at least 30% of the area of the car apron.

An additional improvement of the sound absorption can be achieved in that the porous sound absorption layer bears by its side, which is remote from the main plane of the car apron, against a second metal plate.

In the case of elevators with particularly high-speed cars a sound-absorbing car apron can advantageously be part of a car lining, which serves for improvement of the aerodynamic characteristics of the elevator car.

An additional reduction in the noises generated by the air flow in the region of the car opening can be achieved in that the shaft wall opposite the car apron and at the shaft door side is additionally covered by a sound-absorbing layer. In the ideal case the door leaves of the shaft doors also have a sound-absorbing coating.

DESCRIPTION OF THE DRAWINGS

The above, as well as other, advantages of the present invention will become readily apparent to those skilled in the art from the following detailed description of a preferred embodiment when considered in the light of the accompanying drawings in which.

DESCRIPTION OF THE PREFERRED EMBODIMENT

Figure 1:
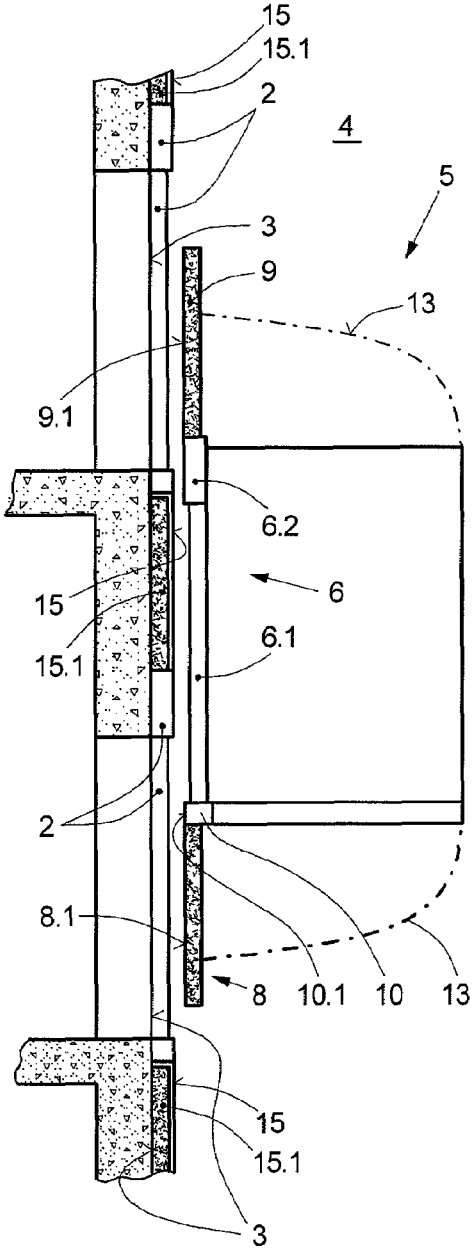
FIG. 1 is a schematic cross-section through an elevator installation with a shaft wall that having the shaft doors, with sound-absorbing shaft door aprons and an elevator car with sound-absorbing car aprons according to the present invention.

A part of an elevator installation according to the present invention is illustrated in FIG. 1, which part comprises a shaft wall 3, which contains shaft doors 2, of an elevator shaft 4 and an elevator car 5, which car is present in the elevator shaft 4, with a car door 6. The car door has leaves 6.1 and a drive unit 6.2 of the car door. A respective lower sound-absorbing car apron 8 and an upper sound-absorbing car apron 9 are rigidly fastened to the elevator car 5. The planes, which face the shaft wall 3, of these car aprons are termed main planes 8.1 and 9.1. The main planes 8.1, 9.1 of the lower and upper car aprons 8, 9 are arranged parallel to the shaft wall 3 at the door side or to the front of the elevator car 5 at the door side and in alignment with a front edge 10.1 of a door threshold 10 at the elevator car, wherein the lower car apron 8 extends vertically downwards from the door threshold 10 through approximately a meter of length and the upper car apron 9 extends vertically upwards from the upper end of the car door 6.

In addition, it is recognizable from FIG. 1 that the shaft wall 3 at the door side is covered between two shaft doors 2 by sound-absorbing means in the form of shaft wall aprons 15. Such sound-absorbing shaft door aprons 15 advantageously extend over the entire region between two adjacent ones of the shaft doors 2. In the case of large distances between two adjacent shaft doors, however, they can also have only a limited height, for example, the height of a prescribed shaft door apron.

Figure 2:
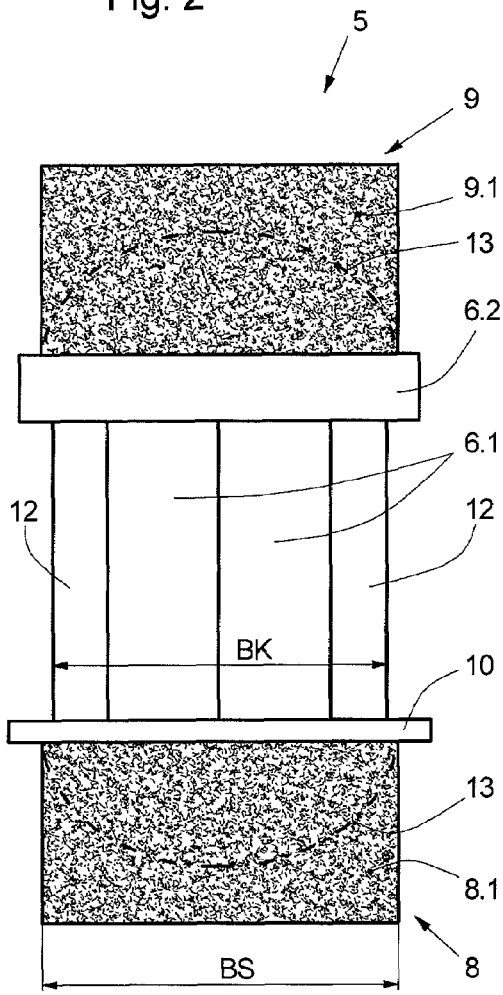
FIG. 2 is a schematic view, from a shaft door, of the front of the elevator car with a lower and an upper car apron as shown in FIG. 1.

FIG. 2 shows a view, as seen from a one of the shaft doors 2, of the front of the elevator car 5 at the door side. A front wall 12 of the elevator car, the car door 6, which comprises two of the door leaves 6.1 and the door drive unit 6.2, the door threshold 10 and the main planes 8.1, 9.1 of the lower and upper sound-absorbing car aprons 8, 9 can be seen. A width BS of the car apron substantially corresponds with a width BK of the elevator car 5. Due to different ratios between the car width and the shaft width as well as due to different maximum travel speeds of the elevator car, the width BS of the car apron can deviate from the width BK of the elevator car by 20% downwardly or upwardly.

Figure 3:
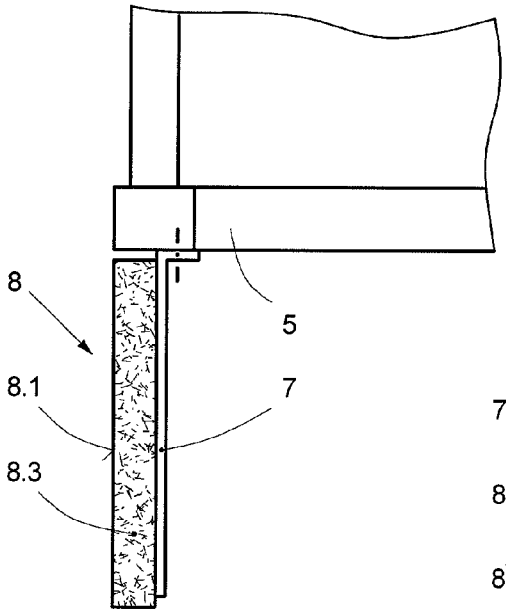
FIG. 3 is an enlarged fragmentary view of a first variant of the car apron with a sound absorption layer according to the present invention.

FIG. 3 shows one possible variant of mounting of the car apron 8 with a sound absorption layer 8.3. The sound absorption layer 8.3 is fastened to the elevator car 5 by means of a stabilizing metal plate 7, wherein the sound absorption layer 8.3 faces the shaft wall at the shaft door side and forms the main plane 8.1 of the car apron 8. The sound absorption layer 8.3 typically has a thickness in a range of twenty to two hundred millimeters, preferably a thickness of fifty to one hundred fifty millimeters, measured at right angles to the plane of the shaft wall 3 at the shaft door side.

Figure 4:
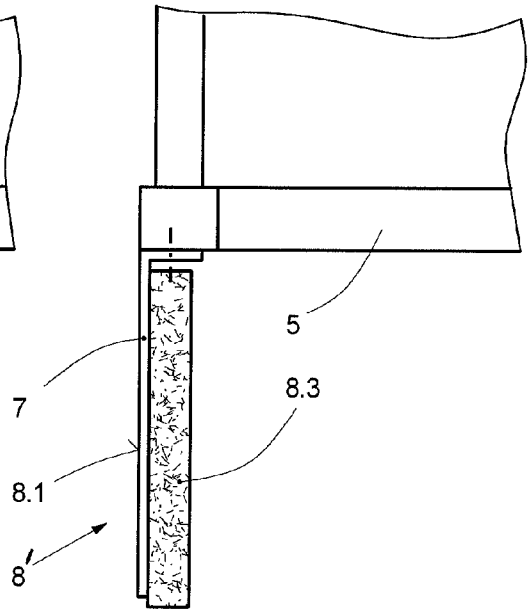
FIG. 4 is a view similar to FIG. 3 of a second variant of the car apron with a sound absorption layer according to the present invention.

Another variant of mounting of the car apron is a car apron 8' with the sound absorption layer 8.3 as illustrated in FIG. 4. The sound absorption layer 8.3 in this embodiment is similarly fastened to the elevator car by means of the stabilizing metal plate 7. However, the sound absorption layer is fixed to the side, which is remote from the shaft wall at the shaft wall side, of the metal plate 7 so that the latter forms the main plane 8.1 of the car apron 8'. The metal plate 7 can be present as a compact plate or have a plurality of holes as is described further below in connection with FIG. 6.

Figure 5:
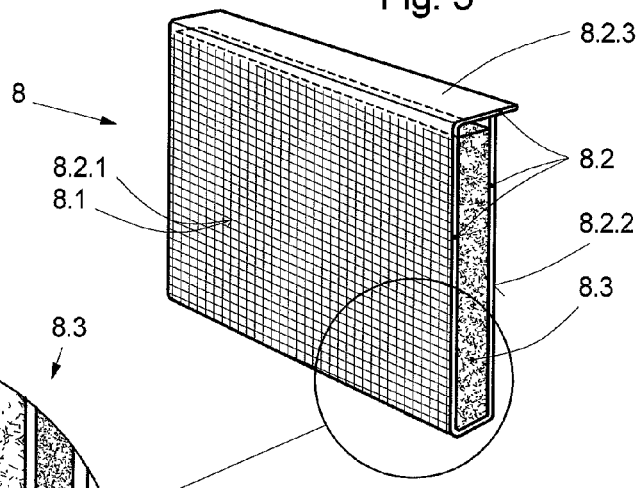
FIG. 5 is a perspective view of a preferred embodiment of the lower car apron according to the present invention.

A preferred form of embodiment of the sound-absorbing (lower) car apron 8 according to the present invention is shown in FIG. 5. The car apron 8 comprises a langed sheet metal box 8.2 forming a hollow body with a front side 8.2.1 and a rear side 8.2.2. The front side 8.2.1 of the car apron 8 in that case corresponds with the main plane 8.1 thereof, which ensures the safety and wind guidance functions mentioned in the introduction. A cavity of the sheet metal box 8.2 is filled with the sound absorption layer 8.3, which bears against the front side 8.2.1 and also the rear side 8.2.2 of the sheet metal box 8.2. An upper flange 8.2.3 of the sheet metal box serves for fastening the car apron 8 to the underside of the elevator car 5. Preferably materials such as mineral fibers (for example, glass fibers, rock wool fibers, ceramic fibers), organic fibers, open-cell foam materials (for example, PUR foam material, melamine resin foam material), etc., are suitable for use in a sound absorption layer according to the present invention. The sound absorption layer 8.3 can also consist of a mixture of such materials or be present in the form of several part layers, wherein the individual part layers are preferably made of different materials. Several sound absorption layers comprising part layers are particularly suitable for absorption of noises with a wide sound frequency spectrum.

Figure 6:
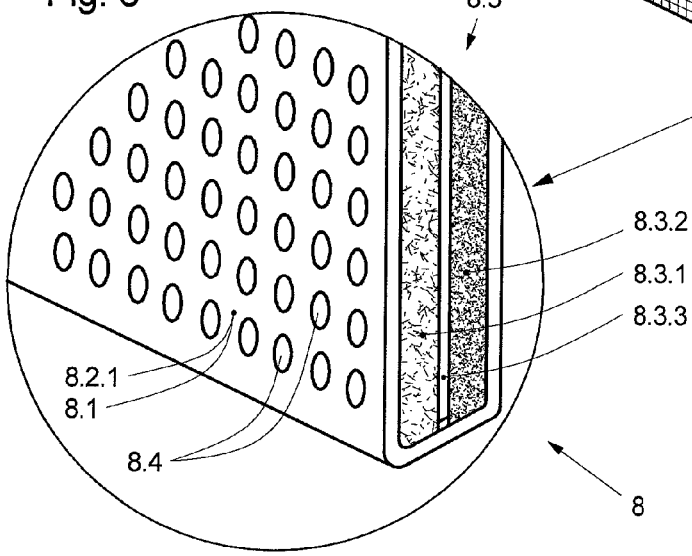
FIG. 6 is an enlarged detail of the lower car apron according to FIG. 5.

FIG. 6 shows an enlarged detail of the car apron 8 shown in FIG. 5. It can be seen that the sound absorption layer 8.3 comprises two part layers 8.3.1, 8.3.2 of different materials, wherein a metal plate 8.3.3 is inserted between the part layers. It is achieved by such an embodiment of the sound absorption layer that, by comparison with a car apron having only a single sound absorption layer, the sound absorption capability is improved and the absorption spectrum widened. It is also illustrated by FIG. 6 that the front side 8.2.1, which forms the main plane 8.1 of the car apron 8 and which ensures the safety and wind guidance function, has a plurality of circular holes 8.4 formed therein. Tests have shown that the presence of such holes 8.4 in the front side, which forms the main plane 8.1, of the sound-absorbing car apron 8 significantly increases the sound absorption effect thereof. The holes 8.4 advantageously have a diameter in a range of two millimeters to twenty millimeters and in total form an open area corresponding with at least 30% of the area of the front side 8.2.1 of the car apron 8.

It can be inferred from FIGS. 1 and 2 that the elevator car 5 can be equipped with lower and upper streamlined car linings 13 (illustrated as dot-dashed lines). In such cases the sound-absorbing car aprons can be constructed as parts of these car linings 13.

In order to produce an optimum reduction in the wind noises generated by the moving elevator car further parts of the elevator car, in the extreme case its entire outer surface, can be covered with sound-absorbing means.

In accordance with the provisions of the patent statutes, the present invention has been described in what is considered to represent its preferred embodiment. However, it should be noted that the invention can be practiced otherwise than as specifically illustrated and described without departing from its spirit or scope.

What is claimed is:

1. An elevator installation comprising an elevator car that moves in an elevator shaft provided with shaft doors, wherein the elevator car has at least one car apron that is arranged substantially parallel to a plane of the shaft wall at the shaft door side, and a device for reducing noises arising in a region of the at least one car apron comprising: a sound-absorbing means formed from a sound-absorbing material mounted at the at least one car apron.

2. The elevator installation according to claim 1 including another sound-absorbing means mounted at shaft door aprons adjacent the shaft doors.

3. The elevator installation according to claim 1 wherein said sound-absorbing means includes at least one sound absorption layer is formed of at least one material selected from a group of mineral fibers, organic fibers. ceramic fibers. foamed plastics and open-cell foam material.

4. Thc elevator installation according to claim 3 wherein said at least one sound absorption layer includes at least two part layers formed of different of sound-absorbing materials.

5. The elevator installation according to claim 1 wherein the at least one car apron includes a plate arranged parallel to a main plane of the at least one car apron and against which said sound-absorbing means bears at the side thereof remote from the shaft wall at the shaft door side.

6. The elevator installation according to claim 5 wherein said plate has a plurality of holes formed therein, wherein a total of areas of said holes is at least 30% of a total area of said at least one car apron.

7. The elevator installation according to claim 1 wherein said at least one car apron is part of a car lining mounted on and improving aerodynamic characteristics of the elevator car.

8. An elevator installation comprising an elevator car that moves in an elevator shaft provided with shaft doors, wherein the elevator car has upper and lower car aprons that are arranged substantially parallel to a plane of the shaft wall at the shaft door side, and a device for reducing noises arising in a region of the car apron comprising:

a first sound-absorbing means formed from a sound-absorbing material mounted at the upper car apron;

a second sound-absorbing means formed from a sound-absorbing material mounted at the lower car apron; and a third sound-absorbing means formed from a sound-absorbing material mounted at shaft door aprons adjacent the shaft doors.

9. The elevator installation according to claim 1 wherein, the at least one car apron includes a plate arranged parallel to a main plane of the at least one car apron and against which said sound-absorbing means bears at a side thereof facing the shaft wall at the shaft door side.

10. The elevator installation according to claim 1 wherein the at least one car apron comprises a box forming a hollow body, said box being filled with said sound-absorbing means.

11. The elevator installation according to claim 1 wherein the at least one car apron comprises a box forming a hollow body, said box being filled with said sound-absorbing means and including a front side and a rear side, at least said front side having a plurality of holes formed therein, wherein a total of areas of said holes is at least 30% of a total area of said front side of the at least one car apron.

12. The elevator installation according to claim 11 wherein said front side corresponds to a main plane of the at least one car apron.

13. The elevator installation according to claim 11 wherein said sound-absorbing means includes at least two part layers formed of sound-absorbing material and a vibratory plate inserted between said at least two part layers, said vibratory plate forming a vibrational mass.

14. The elevator installation according to claim 1 wherein the at least one car apron comprises a box forming a hollow body and including a front side conesponding to a main plane of the at least one car apron, said box being filled with said sound-absorbing means, the at least one car apron being part of a car lining mounted on the elevator car and improving aerodynamic characteristics of the elevator car.

15. The elevator installation according to claim 3 wherein the at least one car apron includes a plate arranged parallel to a main plane of the at least one car apron and against which said sound absorption bears at the side thereof remote from the shaft wall at the shaft door side.

16. The elevator installation according to claim 15 wherein said plate has a plurality of holes formed therein, wherein a total of areas of said holes is at least 30% of a total area of said at least one car apron.

17. The elevator installation according to claim 16 wherein said holes have a diameter in a range of 2 millimeters to 20 millimeters.

18. The elevator installation according to claim 3 wherein the at least one car apron includes a plate arranged parallel to a main plane of the at least one car apron and against which said sound absorption bears at the side thereof facing the shaft wall at the shaft door side.

19. The elevator installation according to claim 3 wherein the at least one car apron comprises a box forming a hollow body, said box being filled with said at least one sound absorption layer.

20. The elevator installation according to claim 3 wherein the at least one car apron comprises a box forming a hollow body, said box being filled with said at least one sound absorption layer and including a front side and a rear side, at least said front side having a plurality of holes formed therein, wherein a total of areas of said holes is at least 30% of a total area of said front side of the at least one car apron.

21. The elevator installation according to claim 20 wherein said front side corresponds to a main plane of the at least one car apron.

22. The elevator installation according to claim 21 wherein said at least one sound absorption layer includes at least two part layers formed of sound-absorbing material and a vibratory plate inserted between said at least two part layers, said vibratory plate forming a vibrational mass.

23. The elevator installation according to claim 6 wherein said boles have a diameter in a range of 2 millimeters to 20 millimeters.

24. An elevator installation having an elevator car that moves in an elevator shaft provided with shaft doors, wherein the elevator car has at least one car apron that is arranged substantially parallel to a plane of the shaft wall at the shaft door side, and a device for reducing noises arising in a region of the car apron comprising: a sound-absorbing means mounted at the at least one car apron, said sound-absorbing means including at least one porous sound absorption layer, wherein the at least one car apron includes a metal plate arranged parallel to a main plane of the at least one car apron and against which said at least one porous sound absorption layer bears at the side Thereof remote from the shaft wall at the shaft door side, and wherein said metal plate has a plurality of generally circular holes formed therein, said holes having a diameter in a range of 2 millimeters to 20 millimeters, wherein a total of areas of said holes is at least 30% of a total area of said main plane of said at least one car apron.

* * * * *

UNITED STATES PATENT AND TRADEMARK OFFICE

CERTIFICATE OF CORRECTION

PATENT NO. : 7,325,656 B2
APPLICATION NO. : 11/420306
DATED : February 5, 2008
INVENTOR(S) : Oberer et al.

It is certified that error appears in the above-identified patent and that said Letters Patent is hereby corrected as shown below:

Title page, item (75) Inventors: should read

Alex Oberer, Ennetburgen (CH);
Yvan Kurzo, Luzern (CH);
Philip Leistner, Stuttgart (DE)

Signed and Sealed this

Twenty-seventh Day of May, 2008

JON W. DUDAS
*Director of the United States Patent and Trademark Office*